United States Patent [19]

Theurer

[11] 4,160,418

[45] Jul. 10, 1979

[54] MOBILE APPARATUS FOR CONTINUOUS TRACK RENEWAL

[75] Inventor: Josef Theurer, Vienna, Austria

[73] Assignee: Franz Plasser Bahnbaumaschinen-Industriegesellschaft m.b.H., Vienna, Austria

[21] Appl. No.: 828,337

[22] Filed: Aug. 29, 1977

[30] Foreign Application Priority Data

Oct. 15, 1976 [AT] Austria ..... 7719/76

[51] Int. Cl.[2] ..... E01B 27/11; E01B 29/05

[52] U.S. Cl. ..... 104/2; 104/6

[58] Field of Search ..... 104/2, 3, 4, 5, 6, 7 R, 104/7 A, 7 B, 8; 105/168, 367, 393

[56] References Cited

U.S. PATENT DOCUMENTS

| | | | |
|---|---|---|---|
| 986,981 | 3/1911 | Hern et al. | 105/393 X |
| 3,469,534 | 9/1969 | Plasser et al. | 104/7 B |
| 3,699,894 | 10/1972 | Plasser et al. | 104/2 |
| 3,807,310 | 4/1974 | Plasser et al. | 104/2 |
| 3,812,791 | 5/1974 | Barnard | 105/393 |
| 3,972,292 | 8/1976 | Theurer | 104/2 |

FOREIGN PATENT DOCUMENTS

| | | | |
|---|---|---|---|
| 767266 | 3/1952 | Fed. Rep. of Germany | 105/168 |
| 1339842 | 12/1973 | United Kingdom | 104/2 |

*Primary Examiner*—Albert J. Makay
*Assistant Examiner*—Randolph A. Reese
*Attorney, Agent, or Firm*—Kurt Kelman

[57] ABSTRACT

A track renewal train equipped for continuous replacement of track rails and ties has a first train section mounted for movement on an old track section, a second train section mounted for movement on a new track section, and an intermediate train section consisting of a carrier frame and linking the first and second train sections, the carrier frame bridging a trackless intermediate right of way section. The two ends of the carrier frame are coupled to undercarriages respectively running on the old and new track sections and the carrier frame consists of two parts. A vertical pivot couples the two carrier frame parts together for pivotal movement in a plane parallel to the track and a device is provided for pivoting the two carrier frame parts in this plane and for fixing the same in selected positions.

6 Claims, 8 Drawing Figures

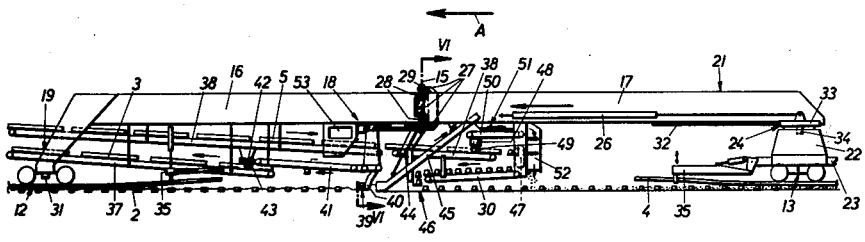

MOBILE APPARATUS FOR CONTINUOUS TRACK RENEWAL

The present invention relates to improvements in a mobile apparatus for the continuous renewal of a track consisting of ties and two rails.

Mobile apparatus for continuously replacing the old ties of a track by new ties and, preferably, also the old rails by new rails is known, for example, from U.S. Pat. Nos. 3,699,894, dated Oct. 24, 1972, and 3,807,310, dated Apr. 30, 1974. Such apparatus comprises a train of freight cars mounted for continuous movement along a right of way consisting of an old track section, a new track section and an intermediate right of way section which is trackless and wherein the track is renewed. A first section of the train is mounted for movement on the old track section, a second section of the train is mounted for movement on the new track section, and an intermediate train section consisting of a carrier frame and linking the first and second train sections bridges the intermediate right of way section. The carrier frame has two ends respectively carried on undercarriages respectively running on the old and the new track sections, the carrier frame ends being mounted for pivoting about a substantially vertical axis in a plane substantially parallel to the track. The train sections carry equipment arranged to transport old and new ties, to remove old ties from the intermediate right of way section and to lay new ties thereat, and to lift and spread the rails in the intermediate right of way section and to guide the rails substantially without friction.

Mobile apparatus of this type has the advantage of enabling assembly line track replacement to be effected while the renewal train moves continuously along the right of way, taking into account also the flexing to which the rails are subjected and making it possible to center the track removal and laying equipment properly in tangent track and curves.

Another mobile apparatus of this general type is disclosed in British Pat. No. 1,339,842. In this apparatus, adaptation to changes in the course of the track is obtained by providing a center section which consists of two track transport cars each having an overhanging portion facing each other and pivotally coupled togehter by an interposed beam. This pivotal coupling causes difficulties in sharp curves in guiding the old and new rails, and may lead to unforeseeable bends in the old rails to be removed and the new rails to be laid. In other words, it is impossible to guide the rails properly in tangent and curved track sections. Furthermore, this apparatus is difficult to use since the swivel trucks supporting the transport cars also are subject to the loads of the interconnecting beam. This makes the use of the apparatus in branch lines altogether impossible. In addition, the apparatus is quite expensive and its construction complex. Additional difficulties are encountered in moving the apparatus from working site to working site since the interposed beam alone is not movable on the track and the entire train must, therefore, be moved and maneuvered. The interposed beam also requires vertical pivoting means at its coupling points to avoid breakage under excess loads. Adaptation to changes in the course of the track are not possible with this apparatus since the position of the interposed beam is fixed by the course of the old and new track, and cannot be changed. For this reason, the apparatus cannot be used in a transition curve.

In U.S. Pat. No. 3,807,310, the intermediate train section is constituted by a rigid carrier frame mounted at its ends on undercarriages running on the track. This apparatus has been used very successfully in track renewal operations, including replacement of relatively heavy track, and the axle loads can be held relatively low. Such an intermediate section is quite readily movable and may be used for a variety of track replacement operations. However, the equipment for removing and laying the ties and track rails, as well as any equipment for excavating and planing the ballast, and like track surfacing equipment, must be mounted for transverse movement in relation to the track to adapt it approximately to the course of the track, which makes added drives for moving the equipment sideways necessary. A better adaptation to the course of the track could be obtained by moving the rigid carrier beam transversely in relation to the supporting undercarriages but this involves an expensive construction.

It is the primary object of this invention to improve the latter type of mobile track renewal or replacement apparatus by providing not only a highly economical and simple structure adapted to renew light or heavy track, such as track with concrete ties, but one readily adaptable to changing track courses so as to produce rapid and simple assembly line renewal of track.

This and other objects are accomplished unexpectedly by the simple expedient of making the carrier frame in two parts, a substantially vertical pivot coupling the two carrier frame parts together for pivotal movement in a plane substantially parallel to the track, and providing a device for pivoting the two carrier frame parts in this plane and for fixing the same in selected pivotal positions.

This structure retains not only the advantages that the intermediate train section is highly mobile and, therefore, usable in a variety of track renewal operations and that the axle loads may be held low so as to avoid overloading the newly laid track, in which the rails may not yet be fastened to the ties, but it adds the primary advantage of enabling a greatly improved adaptation to the existing course of the track. Since the two carrier frame parts may be pivoted in relation to each other to assume any selected pivotal position even during the continuously proceeding renewal operation, the track removal and laying equipment mounted on the carrier frame parts can at all times be correctly positioned according to the course of the track. This considerably increases not only the accuracy but also the speed of the renewal operation, whether only the ties or rails are replaced, or both. At the same time, the structure is very simple while the pivoting device makes it possible to fix the two carrier frame parts in any selected pivotal position desired, depending on the course of the track, for instance the extent of the track curve.

The above and other objects, advantages and features of the invention will become more apparent from the following detailed description of a now preferred embodiment thereof, taken in conjunction with the accompanying drawings wherein FIGS. 1 and 2 show a schematic side elevational view of a mobile apparatus comprising a train of freight cars mounted for continuous movement along a right of way;

FIG. 3 schematically illustrates a detail of the support of the rear carrier frame part, with its end moved inwardly over the supporting car;

FIGS. 7 and 8 are schematic top views showing the pivotally interconnected carrier frame parts adjusted to different pivotal positions adapted to different track curves, FIG. 7 illustrating two different operating positions while FIG. 8 shows the carrier frame with its support closer together in travel position.

Figure 1:
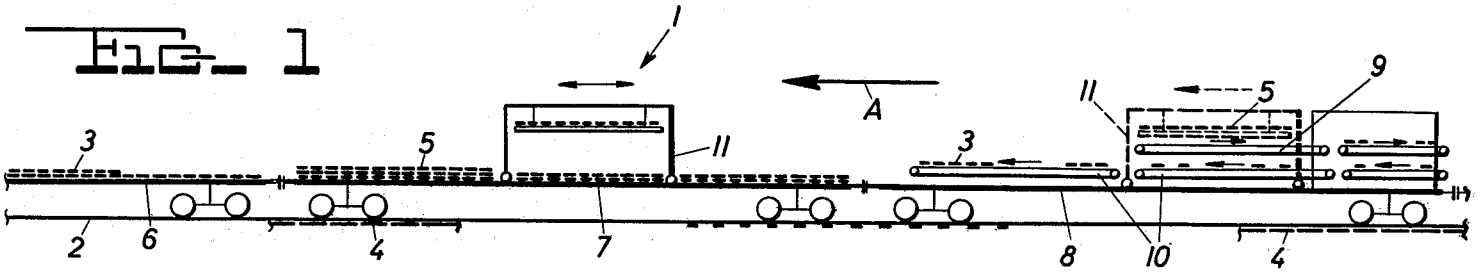
Figure 2:
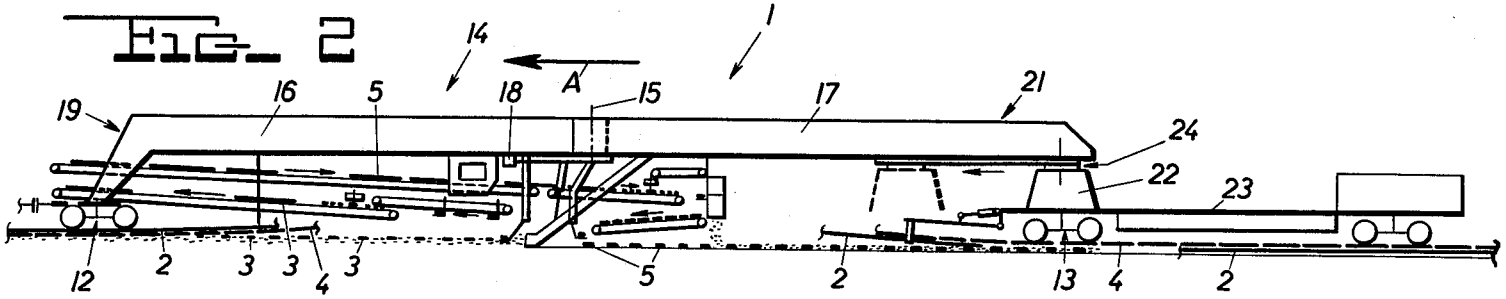

As shown in FIG. 1, train 1 comprises freight cars 6, 7 and 8 carrying equipment arranged to transport old ties 3 and new ties 5, as well as old rails 2 and new rails 4 (illustrated in broken lines). All of this equipment is conventional, as disclosed in the above-mentioned patents, and is, therefore, merely schematically indicated on the drawing, including conveyors 9 and 10 for transporting old ties 3 away and for transporting new ties 5 toward the renewal site, gantry crane 11 (shown in different positions in full and broken lines) being movable along the flat freight cars for moving the ties along the train. The freight cars are coupled together in the conventional manner and, as shown in FIG. 2, freight car 8 is also coupled to undercarriage 12 carrying end 19 of carrier frame 14, the other end 21 of the carrier frame being carried by undercarriage 13. As shown, undercarriage 12 runs on the old track section consisting of rails 2 fastened to ties 3 while undercarriage 13 runs on the new track section consisiting of rails 4 laid on ties 5. The train is mounted for continuous movement in the direction of arrows A along a right of way consisiting of the old and new track sections and an intermediate right of way section wherein the track is renewed, i.e. the old ties and rails are removed and the new ties and rails are laid, all in a manner and by equipment well known. Between undercarriages 12 and 13, the old and new rails are lifted and spread apart a distance equal at least to the length of the old and new ties. The old rails 2 are unfastened from their ties and, together with new rails 4 positioned laterally outside the ends of the ties, lifted and guided without substantial friction over the trackless intermediate section of the right of way, which is bridged by carrier frame 14. While the train continuously advances in the direction of arrows A, new ties 5 are laid and new rails 4 are placed thereon at the desired track gage while old rails 2 are removed either between new rails 4, or, after they have crossed over at different levels, outside the ends of new ties 5. The spreading of the rails makes it possible to remove and lay the ties without difficulty and also to excavate, clean and plane the cleaned ballast in the intermediate section before the new track is laid. All of this is conventional.

In accordance with the present invention and to enable the track renewal equipment to be centered more properly and readily, carrier frame 14 consists of forward part 16 and rear part 17, as seen in the direction of movement of the apparatus. Substantially vertical pivot 15 couples carrier frame parts 16 and 17 together for pivotal movement in a plane substantially parallel to the track. Device 18, which may be simply a hydraulic jack, enables the two carrier frame parts to be pivoted in this plane and to be fixed in selected pivotal positions.

In the illustrated embodiment, undercarriage 12 running on the old track section and carrying front end 19 of carrier frame 14 is a swivel truck while undercarriage 13 running on the new track section is an undercarriage of a car 23 running thereon. Rear carrier frame end 21 is mounted on car 23 for pivoting about a vertical axis constituted by pivot bearing 24. Bearing block 22 is mounted on the car and the pivot bearing is carried by the block. The pivot bearing carries an elongated guide constituting one part of guide means cooperating with another elongated guide part 20 mounted on the carrier frame, the guide means parts cooperating to move the carrier frame in relation to the car whereby the effective length of the carrier frame over the intermediate right of way section may be adjusted between the extended position shown in full lines in FIG. 2 and a shortened position indicated in broken lines in FIG. 2 and illustrated in FIG. 3.

Such an arrangement has the advantage that the support points of the carrier frame are sufficiently spaced apart during renewal operations, for instance a distance of 36 m, while shortening the length of the train when it travels between working sites, the distance between undercarriages 12 and 13 being reduced to 30 m, for example. In addition, by selecting the distance between the carrier frame supports on the old and new track sections, respectively, the apparatus may be used in the renewal of branch lines, for example, where the track is lighter, with a shortened effective carrier frame length. The particularly illustrated mounting of rear end 21 of the carrier frame on a bearing block makes it possible to use any conventional railroad freight car for support of the rear end without requiring special supports or braces at the rear end. Other suitable pivotal mountings may be used, however.

If desired, car 23 may be the locomotive for train 1 and may carry a common power source, such as a hydraulic fluid sump, for all the drives, such as jacks 18 and 26. Also, as is known, operating cabs may be mounted below the platform of car 23 to house operators who can fasten new rails 4 to new ties 5.

Figure 3:
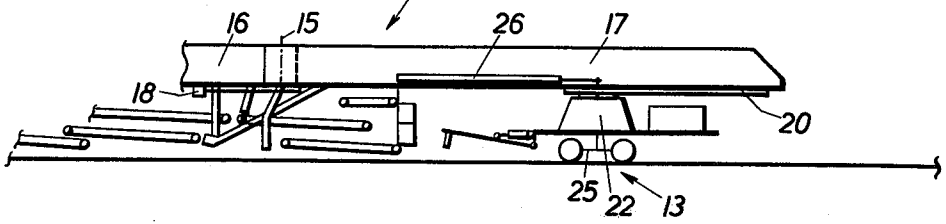

In the modification of FIG. 3, bearing block 22 carrying rear end 17 of carrier frame 14 is mounted on swivel truck 25, which is equivalent to undercarriage 13, and drive means 26, such as a hydraulic jack, is provided for moving the carrier frame in relation to swivel truck 25, cooperating elongated guide means 20 enabling the relative movement.

Figure 4:
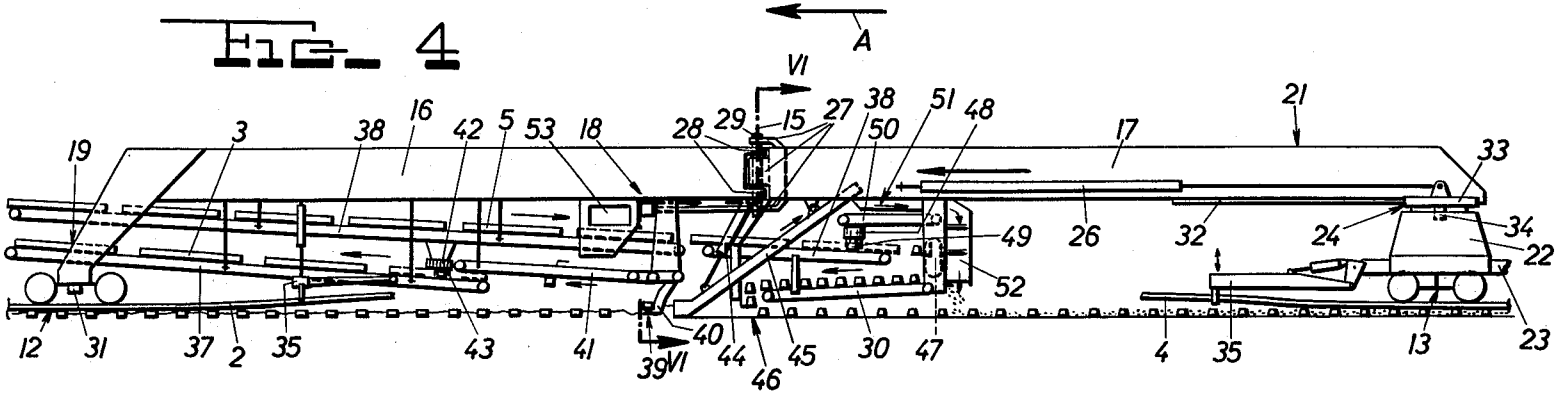
FIG. 4 is an enlarged side elevational view of the carrier frame and the equipment carried thereby.
Figure 5:
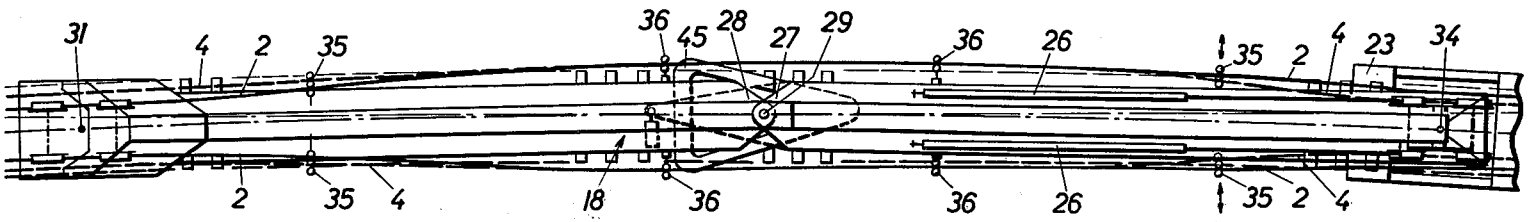
FIG. 5 is a top view of FIG. 4.

Details of the structure may be seen more fully on FIGS. 4 and 5. As shown therein, vertical pivot 15 coupling carrier frame parts 16 and 17 together comprises bearing parts 27 on carrier frame part 16 and bearing parts 28 on carrier frame part 17, the bearing parts 28 overlapping bearing parts 27 and pivot pin 29 passing through the bearing parts and journaled therein. Pivoting and fixing device 18 comprises a hydraulic jack whose cylinder is connected to front carrier frame part 16 and whose piston rod is connected to rear carrier frame part 17.

Pivot pin 31 supports front end 19 of the carrier frame on swivel truck 12. Rear end 21 has an elongated guide 32 cooperating with guide 33 carried by a bearing plate of pivot bearing 24, the bearing plate being mounted on bearing block 22 by pivot pin 34. Drive 26 enables the carrier frame and swivel undercarriage 13 to be moved relatively to each other.

The equipment for removing and transporting the old ties, transporting and laying the new ties, lifting, spreading and removing the old rails, and transporting and laying the new rails, as well as for excavating and cleaning the ballast and redistributing and planing the cleaned ballast is generally conventional and will, therefore, be described only briefly in connection with the schematic showing of such equipment in FIGS. 4 and 5.

Rail lifting and spreading equipment 35 is mounted on front carrier frame part 16 and on car 23 for lifting and spreading old rails 2 and new rails 4, these rails being guided in their spread and lifted state substantially without friction by guide rollers 36 which are vertically and laterally adjustably mounted on the carrier frame parts. Furthermore, equipment 37 and 38 for transporting ties is mounted on carrier frame part 16, this equipment being comprised of endless conveyors suspended on rods from the carrier frame part. Also mounted on this carrier frame part is tie take-up device 39 including vertically movably hook-shaped take-up tool 40 arranged to subtend old ties 3 and lift them to endless conveyor 41, also suspended on rods from carrier frame part 16, conveyor 41 having a series of entrainment elements devised to receive the lifted old ties from tool 40 and move them one by one to turntable 42. The turntable includes a tie gripping device 43 which receives the old ties, as they come from conveyor 41, and the turntable turns them by 90° from their original position extending transversely to the track to a position extending in the direction of the track. In this position, the old ties are delivered to transport conveyor 37 which moves them in a first direction away from the track renewal site.

Immediately following the take-up of the old ties, ballast excavating equipment 45 is mounted on carrier frame part 16 for removing the ballast and cleaning it, the cleaned ballast being returned to the bed and planed by this equipment. Hydraulic drives 44 enable this ballast treating equipment to be vertically and laterally adjusted, all in a well known manner.

Mounted on rear carrier frame part 17 is new tie laying device 46 which is a vertically adjustable tool similar to take-up device 40 and arranged to receive new ties 5 from endless conveyor 30 which, in turn, has received them from vertical conveyor 47 arranged between tie transport conveyor 38 and intermediate conveyor 30. As is indicated by arrows, conveyor 38 transports new ties 5 in a direction opposite to the direction of transportation of old ties 3. Turntable 48 with tie gripping device 49 turns the new ties coming from conveyor 38 by 90° from their original position extending in the direction of the track to a position transversely thereto so that the new ties will be positioned properly for being laid.

The above-described tie transport arrangement assures a very advantageous load distribution since the old and new ties are transported substantially only in the range of the front carrier frame part, which rests on the old track, while the rear carrier frame part, which rests on the new track whose rails may not yet be fastened to the new ties, is relatively free of load of the tie transport equipment. Furthermore, the turntables make it possible to transport the ties over a major portion of their transport path in a narrow path. The arrangement of the ballast excavating and planing equipment between the tie removing and tie laying stations provides a very simple means for receiving, cleaning and redistributing the ballast.

The ballast distributing equipment 51 comprises ballast conveyor 50 mounted above turntable 48 and having an inlet end receiving the excavated ballast from excavating equipment 45 and an outlet end delivering the ballast into chute 52 which deposits the ballast in the cribs defined between newly laid ties 5 and, if desired, at the ends of the ties.

Figure 6:
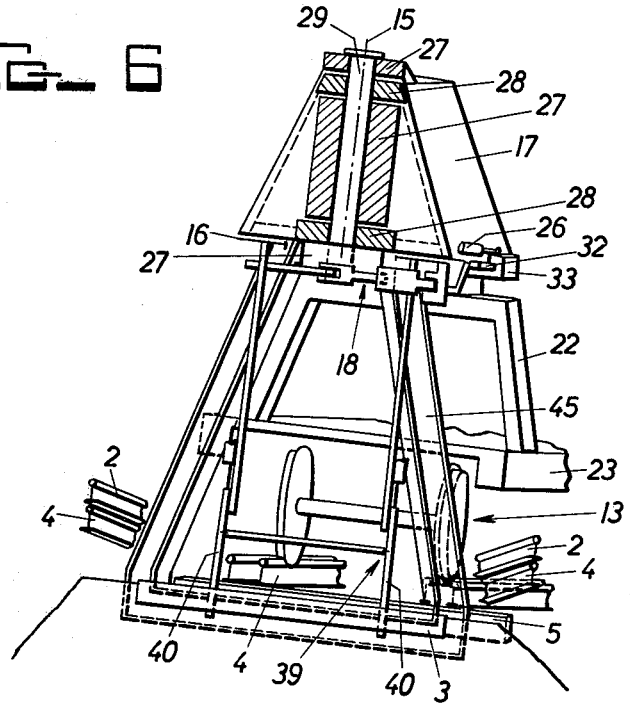
FIG. 6 is a section along line VI—VI of FIG. 4.

FIG. 6 illustrates that ballast excavating and planing equipment 45 as well as old tie take-up equipment 39, 40 are centered in relation to the center line of the track even in a superelevated track curve section in which undercarriage 13 and bearing block 22 supported thereon are laterally offset with respect to the center line. The same holds true for the old and new rails 2 and 4 which are guided one above the other by guide rollers 36 held in fixed relationship to rear carrier frame part 17, as well as for new tie laying device 46 which has not been shown in their figure for the sake of clarity.

It will be advantageous to operate all the drives of the apparatus by remote control from an operator's cab and to feed them from a common power source, such as a hydraulic fluid sump connected to the various hydraulic jacks for pivoting the two carrier frame parts, for moving the carrier frame in relation to its rear support undercarriage, for vertically moving the tie removing and laying devices, and for adjusting the position of the ballast excavating equipment. Hydraulic jacks have the advantage of assuring a yielding drive making operation possible under very rough working conditions and at peak loads. Remote control of the drives makes it possible readily to coordinate the operation of the equipment to adapt to local operating conditions.

The operation of the apparatus during continuous advancement in the direction of arrow A will be partly obvious from the above description of its structure and the assembly line replacement of the old ties and rails by new ties and rails during this advancement of the apparatus will be further described hereinafter in detail:

In the range of, and adjacent to, front undercarriage 12, which still runs on the old track, the rails are lifted by equipment 35 and spread by guide rollers 36 to a distance equal at least to the length of the ties, the guide rollers guiding and holding the lifted rails in their spread condition over the intermediate right of way section which is thus trackless and wherein renewal of the track is carried out. Old ties 3 are taken up by tool 40 between the spread rails and are entrained by conveyor 41 to turntable 42 where gripping device 43 engages successive ones of the old ties and turns them by 90°, the turned ties being deposited on conveyor 37 to be transported to flat car 8 where another turntable turns the ties back into transverse position in which they are further transported by conveyor 10. Gantry crane 11 takes up the ties and moves them to flat car 6 which was used to transport new ties 5 but which is now empty because these ties had previously been moved by the returning gantry crane to flat car 7 whence the gantry crane takes them to conveyor 9 on car 8. The new ties coming from conveyor 9 are turned by 90° by another turntable or endless conveyor pivotal about a central axis to be delivered to conveyor 38 which moves the new ties to turntable 48, vertical conveyor 47 and track laying device 46 to place new ties 5 at a desired spacing on the ballast bed which has meanwhile been excavated and planed by equipment 45. Ballast distributing equipment 51 then distributes excavated ballast in the cribs between the newly laid ties and at their ends, which holds ties 5 in position. All the equipment is remote controlled from operator's cab 53 mounted on the carrier frame at the renewal site.

Where lateral adjustment of the equipment is required, the operator will actuate jack 18 to pivot carrier frame parts 16 and 17 about pivot pin 29 in relation to each other and to fix them in the selected pivotal position, the outer ends of the carrier frame parts pivoting about pivot pins 31 and 34, respectively. In this manner, all the operating equipment will be properly centered in track curves and if the track course changes otherwise from tangent track.

Figure 7:
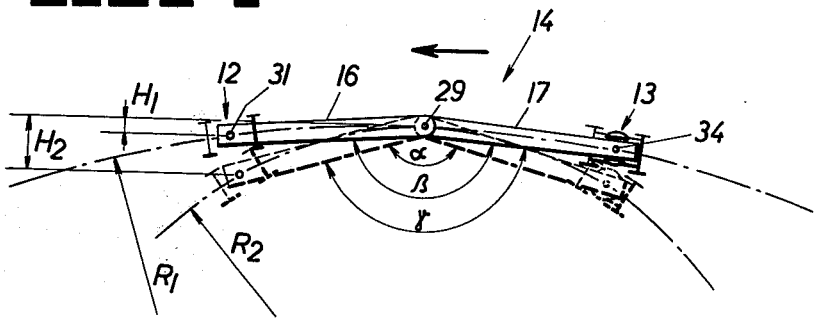

As is shown in FIG. 7, when working in a curve having the radius $R_1$, it is necessary to eliminate ordinate $H_1$ created between a straight line connecting undercarriages 12 and 13 and the arc of the curve in the range of pivot pin 29 which, in the position of carrier frame parts 16 and 17 shown in FIGS. 4 and 5, is centered between the undercarriages. The ordinate is eliminated by pivoting carrier frame parts 16 and 17 until they enclose angle $\beta$. This may be done either by actuating jack 18 or by moving undercarriages 12 and 13 towards each other, with guide 33 remaining stationary while guide 32 slides therealong. The two carrier frame parts are then fixed in their pivotal position by jack 18. In this manner, all the track replacement equipment is properly centered in the range of the vertical pivot of the carrier frame parts. At the same time, the rail lifting and spreading equipment 35, 36 is also suitably positioned to adapt the course of the guided rails to that of the curve so that the rails are also centered. The carrier frame parts themselves are also substantially centered over the right of way over which they run so that further transverse adjustments are normally not required.

As FIG. 7 also shows, the same conditions prevail in curves having a smaller radius $R_2$ and a correspondingly large ordinate $H_2$, requiring pivoting of the carrier frame parts by angle $\alpha$. The two carrier frame parts may be pivoted steplessly and continuously as the radius of the curve changes or in transition curves so that the selected pivotal positions of the two parts may be adapted to such changes, for instance to the position determined by angle $\gamma$. In all positions, the track renewal equipment will be automatically centered while the course of the rails is conformed to the curvature of the track being renewed.

Figure 8:
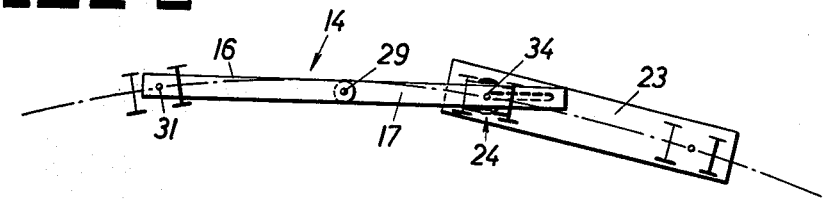

FIG. 8 shows that the position of car 23 does not influence that of pivot pin 34 in the range of bearing block 22 which is the rear end point of the trackless section of the right of way wherein renewal is effected. This figure also shows carrier frame 14 with its parts 16 and 17 rectilinearly aligned and locked in its straightened position by jack 18. This position is particularly adapted for travel of the apparatus from one renewal site to another since the rigid carrier frame will be well suited to transmit tensile and impact forces while the danger of derailment due to pivoting of the frame is eliminated. Furthermore, the distance between undercarriages 12 and 13 can be reduced to the normal distance of 30 m by gliding the rear frame end inwardly, a length of 36 m being necessary when heavy rails are replaced in the trackless working section.

The control of the pivoting of carrier frame parts 16, 17 may be done on the basis of the track curvatures noted on a track map but, if desired, a reference system may be mounted laterally of the track for controlling the pivoting automatically in response to the reference system. In this case, the reference system may be used also for controlling the positioning of the ballast excavating and planing equipment 45. Obviously, the various drives need not be hydraulically operated but could be chain drives, spindle drives, cable drives or any other suitable drive means adapted to move one structural part in relation to another. Furthermore, the old and new ties may be conveyed in any desired manner other than that described and illustrated herein.

What is claimed is:

1. In a mobile apparatus for the continuous renewal of a track consisting of ties and two rails, which comprises a train of freight cars mounted for continuous movement along a right of way consisting of an old track section, a new track section and an intermediate right of way section wherein the track is renewed, a first section of the train being mounted for movement on the old track section, a second section of the train being mounted for movement on the new track section, and an intermediate train section consisting of a carrier frame and linking the first and second train sections and bridging the intermediate right of way section, the carrier frame having two ends respectively carried on undercarriages respectively running on the old and the new track sections, the carrier frame ends being mounted for pivoting about a substantially vertical axis in a plane substantially parallel to the track, and the train sections carrying equipment arranged to transport old and new ties, to remove old ties from the intermediate right of way section and to lay new ties thereat, and to lift and spread the rails in the intermediate right of way section and to guide the rails substantially without friction: the carrier frame consisting of two parts, a substantially vertical pivot coupling the two carrier frame parts together for pivotal movement in a plane substantially parallel to the track, and a device for pivoting the two carrier frame parts in said plane and for fixing the same in selected pivotal positions.

2. In the mobile apparatus of claim 1, the train sections carrying additional equipment arranged to remove the old rails from the intermediate right of way section and to lay new rails thereat.

3. In the mobile apparatus of claim 1, wherein the undercarriage running on the old track section is a swivel truck, the undercarriage running on the new track section is an undercarriage of a car running thereon, the carrier frame end carried by the latter undercarriage being mounted on the car for pivoting about the vertical axis, and further comprising guide means on the latter carrier frame end and on the car, the guide means enabling the carrier frame to be moved longitudinally in relation to the car whereby the effective length of the carrier frame over the intermediate right of way section may be adjusted.

4. In the mobile apparatus of claim 3, a bearing block mounted on the car and pivotally supporting the carrier frame end.

5. In the mobile apparatus of claim 1, wherein the undercarriages are swivel trucks, and a bearing block is mounted on the swivel truck running on the new track, the bearing block carrying a guide constituting one part of a guide means and another guide constituting another part of the guide means being mounted on the carrier frame end for cooperation with the one guide part, the guide means cooperating to move the carrier frame longitudinally in relation to the swivel truck whereby the effective length of the carrier frame over the intermediate right of way section may be adjusted, and drive means for moving the carrier frame on relation to the swivel truck.

6. In the mobile apparatus of claim 1, wherein the equipment arranged to remove old ties from the intermediate right of way section and to lay new ties thereat, and to transport the old and new ties is adapted to move and transport the old and new ties in opposite directions respectively to the new and old track sections, the equipment arranged to remove the old ties being arranged on a first one of the carrier frame parts adjacent the old track section and the equipment arranged to lay the new ties being arranged on a second one of the carrier frame parts adjacent the new track section, a device including a pivoting drive and a tie clamping means associated with the equipment for removing old ties and laying new ties, each of the devices being arranged for turning respective ones of the ties held by the clamping means by 90°, a ballast excavating and planing equipment mounted on the second carrier frame part between the equipment for removing and laying the ties, and a device for selectively distributing excavated ballast in the cribs defined between adjacent ones of the newly laid ties.

* * * * *